US005081852A

United States Patent [19]

Cox

[11] Patent Number: 5,081,852

[45] Date of Patent: Jan. 21, 1992

[54] DISPLAY BRACELET

[76] Inventor: Michael F. Cox, 3499 Oaks Way, Pompano Beach, Fla. 33069

[21] Appl. No.: 656,000

[22] Filed: Feb. 14, 1991

[51] Int. Cl.[5] ..... A44C 5/00

[52] U.S. Cl. ..... 63/3; 63/DIG. 3

[58] Field of Search ..... 63/3, 7, 8, 9, 11, 18, 63/21, 23, DIG. 3, 26; 40/219, 152, 156, 157

[56] References Cited

U.S. PATENT DOCUMENTS

| | | | |
|---|---|---|---|
| 2,041,075 | 5/1936 | Lemmon | 63/26 |
| 2,145,071 | 1/1939 | Cave | 63/26 X |
| 2,322,461 | 6/1943 | Mariano | 63/3 |
| 2,413,541 | 12/1946 | Brady | 63/3 |
| 3,014,298 | 12/1961 | Kirshner | 63/21 X |
| 3,180,042 | 4/1965 | Destal | 63/18 X |
| 3,754,285 | 8/1973 | Greene | 63/DIG. 3 X |
| 4,817,064 | 3/1989 | Milles | 63/21 |
| 4,979,619 | 12/1990 | Hager | 40/156 X |
| 4,984,798 | 1/1991 | Silberstein | 40/156 X |

FOREIGN PATENT DOCUMENTS

| | | | |
|---|---|---|---|
| 709875 | 6/1954 | United Kingdom | 40/219 |

*Primary Examiner*—Gary L. Smith
*Assistant Examiner*—Jerry Redman
*Attorney, Agent, or Firm*—Malin, Haley, McHale, DiMaggio & Crosby

[57] ABSTRACT

An article of jewelry, namely a bracelet having a band containing plurality of individualized transparent compartments with removable transparent windows for displaying on the wrist numerous pictures, photographs, or other decorative or useful items. Further, the windows of the compartments are easily interchangeable and may be transparent, flat, convex for magnification, or some other suitable design. The invention constitutes a multipurpose and easily customized bracelet. Also the inner wall of the band is transparent to permit display of photographs or pictures back-to-back on both sides of the bracelet.

7 Claims, 2 Drawing Sheets

DISPLAY BRACELET

BACKGROUND OF THE INVENTION

1. Field of the Invention

The present invention relates generally to an article of jewelry and specifically to a bracelet having a plurality of transparent double face, display compartments and removable window providing multiple changeable displays of decorative and/or useful items, such as photographs, pictures, holograms or other accessories, for ornamental disposition about the wrist.

2. Description of the Prior Art

An apparatus for ornamentally displaying various small items on one's wrist has long been known in the art. Ornamental bands, bracelets, armlets and other such devices date back to the beginnings of recorded history. It has become customary in some cultures to wear a bracelet onto which various momentos may be attached. A common example of this is the charm bracelet. In such, the "charms" (independent three dimensional miniaturized characters or figurines) are affixed to a supporting chain so that they dangle from the wrist of the wearer. Bracelets housing ornamental designs or pictures are known in the prior art.

Towle, U.S. Pat. No. D166,107, issued Mar. 4, 1952, discloses a religious bracelet useful for the display of two or three permanently mounted religious pictures.

Brady, U.S. Pat. No. 2,413,541, issued Dec. 31, 1946, teaches a bracelet with four magnifying lenses for optically magnifying photographs mounted on a removable backing clamp.

Mariano, U.S. Pat. No. 2,322,461, issued June 22, 1943, discloses three bracelets with reversible display blocks showing dates.

None of the references provide for five individualized double faced viewing compartments that are easily accessible and that can retain two exhibits per compartment, visible in both outwardly and inwardly directions

BRIEF SUMMARY OF THE INVENTION

An article of jewelry comprising a transparent band for encompassing a portion of a wrist, said band having a plurality of individually accessible, double faced, viewing compartments integrally formed with the band, each compartment covered by a removable transparent window member. Preferably each compartment is rectangular and equally sized and spaced equally about the full length of the outer surface of the band. Two small photographs, decorative pictures, holograms, or the like may be mounted back to back within each compartment. The band is constructed in an overall arcuate shape with the ends spaced and of a strategically selected material to allow flexible expansion of the open space between ends to aid in positioning the band over the wrist. The material is also transparent and optically clear through the compartment bottom surface.

Each compartment formed integrally with the band includes a substantially flat optically clear bottom surface surrounded by two parallel side walls extending upwardly and an adjoining end wall. The parallel side walls include longitudinal grooves facing inwardly Each compartment has a removable, flat, transparent window member of a rectangular configuration and extending flanges on at two parallel sides which are sized to fit the slots in the raised side walls of the compartment. The window member slides into position to form a the compartment. The front edge of the window member includes a downwardly extending lip which engages the band edge when the window is in position to frictionally lock the window into place. Photographs or other exhibits are inserted when the window is removed. Two photographs, back to back are firmly in each compartment and are observable, one from the exterior direction through the window and the other with the band removed from the wrist through the inside of the band. With five separate compartments, up to ten different photographs can be displayed.

The compartment walls and slots for the window could also be used to mount a flat thin object such as a wrist watch in a desired predetermined compartment replacing the window. This gives added utility to the device so that it could act as both a watchband and an exhibitor of photographs or pictures.

Preferably for one inch pictures, the device would include five compartments equally spaced o the exterior surface of the band. This number permits an adequate size photograph or picture to be used and the display space occupies a substantial portion of the outer circumference of the device. Such a configuration would permit the use of up to ten photographs, pictures or other designs as desired.

The band, the compartments and the windows may be suitably injection molded from a transparent, clear acrylic polymer material such as Lucite, Plexiglass or Lexan, all trademarks. The material also allows for spring-like flexible action of the band body, allowing the opening between the band ends to be sized smaller than the wrist diameter so that the band will not fall off the wearer's wrist. The band body could use certain opaque colors in non-display areas as well as clear polymers for the main bracelet body.

One or more of the transparent windows may be molded in a dome or partially spherical shape along its outside for magnification to enhance or enlarge a photo that is stored in the compartment below.

As an example of the display versatility of the device, the five 1"×1" compartments could be provisioned with a variety of ornamental displays such as two pictures or photographs back to back, a hologram on top and a picture on the bottom, heads and tails of a thin coin, and various small sheets of designs and printed colors to match one's clothing. It could also house pictures of loved ones, pets, animals, various scenes and holograms. Because of the unique construction of the device, these scenes can easily be changed again and again.

With the selection of certain transparent acrylic polymers discussed above, an index of refraction of 1.491 which is very close to glass can be obtained. Such materials provide for safety, strength and needed flexibility to make the invention lightweight and practical for ornamental wear. The opening formed at the ends of the band that is received over the wrist in its original shape is approximately 1¼ inches on the bottom side which can stretch to beyond 1¾ inches over the wrist of the wearer, for a comfortable universal fit.

It is an object of this invention to provide a bracelet that can be used for displaying numerous photographs, pictures and the like on both sides of the bracelet band.

It is another object of this invention to provide a wrist mounted display for photographs, pictures and holograms which can be removed for observing different photographs on the exterior side and the interior side of the device.

But yet still another object of this invention is to provide an improved ornamental band used as an article of jewelry which includes a plurality of individualized picture holding compartments, each for mounting two pictures back to back and having an easily removable window for each compartment that allows for the insertion or removal of particular photographs or other display objects.

Yet still another object of this invention is to provide for an article of jewelry comprising an ornamental band that has easily changeable display compartments for exchanging displays that can be individually matched by the wearer with the particular wardrobe of the user.

It is another object of this invention to provide an improved ornamental band for the wrist which can carry a plurality of photographs, pictures or may include a wristwatch, all of which are easily interchanged within individualized compartments wherein the device is durable, safe for wearing, and easy to manufacture.

In accordance with these and other objects which will be apparent hereinafter, the instant invention will now be described with particular reference to the accompanying drawings.

PREFERRED EMBODIMENT OF THE INVENTION

Figure 1:
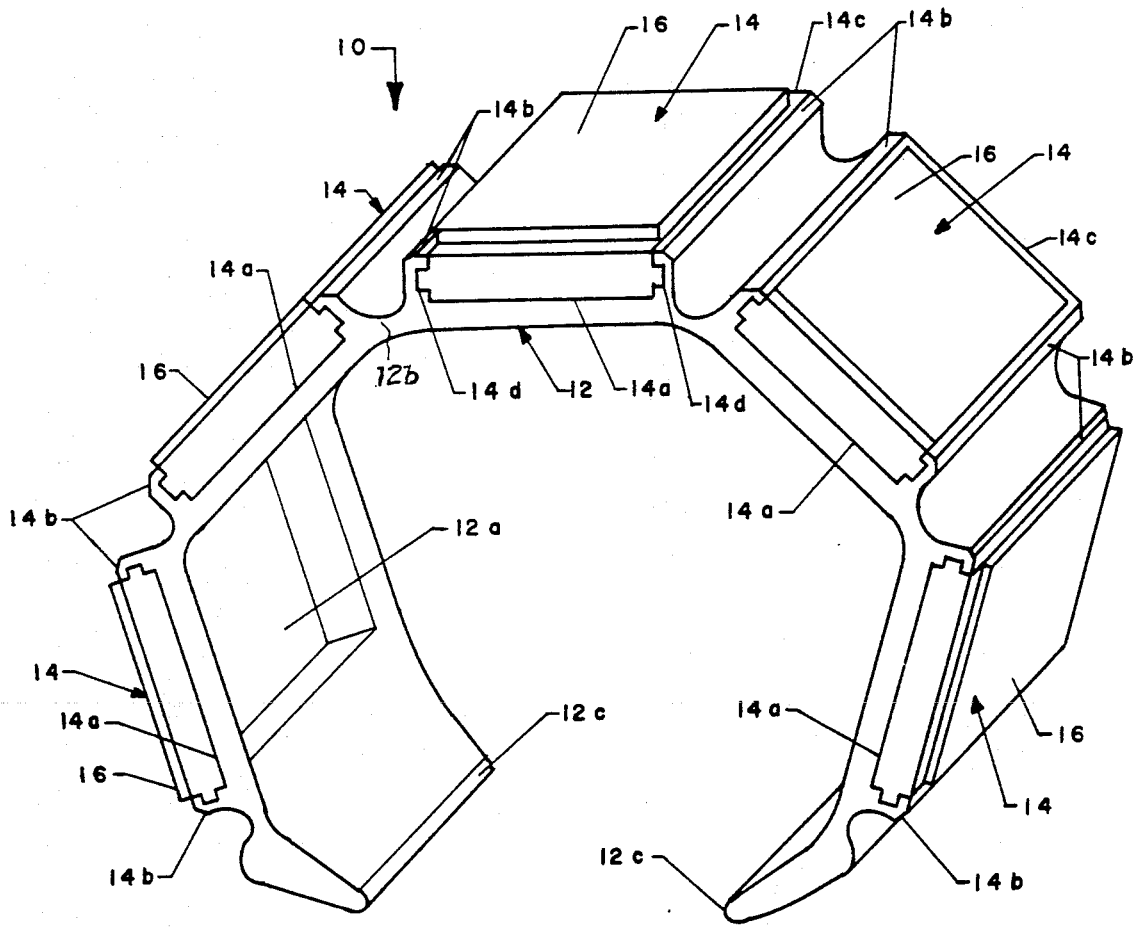
FIG. 1 is a perspective view of the invention.

Referring now to the drawings and in particular FIG. 1, the present invention is shown generally at 10 comprised of a molded arcuately shaped ornamental band 12 having an interior wall of adjacent flat surfaces 12*a* which extend from the ends of the band 12*c* on both sides, sized to encompass a wrist. The molded band 12 is constructed of a transparent acrylic polymer which allows the underside band panels 12*a* to be optically clear and transparent. Five separate display compartments 14, each formed by with a flat transparent surface 14*a*, a pair of parallel lateral side walls 14*b* extending from one lateral side of the band to the opposite lateral side, and end wall 14*c*. Each of the parallel side walls 14*b* include an inwardly facing substantially rectangular slot 14*d* which is sized and adapted to receive a corresponding male tab 16*a* on each side of rectangular window member 16 discussed in greater detail below. The molded construction of the band also inc' .des integrally formed web portions 12*b* which in effect bridge each of the compartments together in a single unit.

In the example as shown, the ornamental band 10 includes an open space between the band ends 12*c* approximately 1⅛". This also corresponds to the outside width of each of the compartments in this example. The construction of the device and the material selected allows the band ends 12*c* to be expanded so that the band can be comfortably placed over the wrist of the wearer.

Each compartment 14 is sized to provide a space defined by the perimeter of flat surface 14*a* defined by the side walls 14*b* which can receive one or two flat, thin photographs, holograms or other ornamental sheets to fit snuggly within the compartment space 14.

Figure 2:
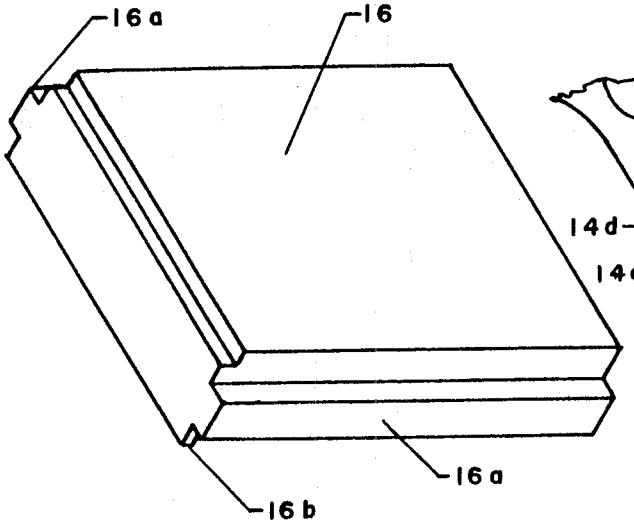
FIG. 2 is a perspective view of a compartment window of the invention.

Each compartment 14 includes a removable window member 16 which is a rectangular flat transparent panel that slides laterally from one side of the band within the side wall slots 14*c* to completely cover the compartment 14. FIG. 2 shows the flat transparent window member 16 which includes projecting tabs 16*a* that are sized and shaped to fit snugly into the compartment side wall slots 14*c* which run the length of each window member 16 on two parallel sides. The thickness of the window member 16 is such that it permits thin sheets representing photographs, pictures or other ornamental designs on sheets to be disposed between the lower surface of the window member 16 and the upper surface 14*a* of the compartment. The window member 16 is constructed of a transparent acrylic polymer as described above.

Figure 3:
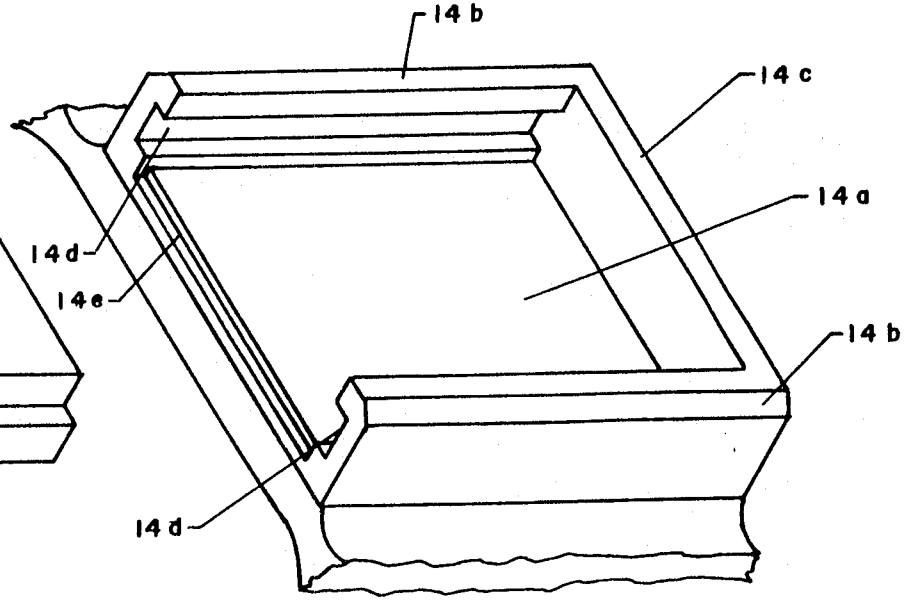
FIG. 3 is a perspective view of a compartment member.

FIG. 3 shows a single compartment without the window that includes the raised side walls 14*b* and the flat transparent surface 14*a*. Two photographs or pictures, back-to-back, can be disposed against planar surface 14*a*.

Figure 4:
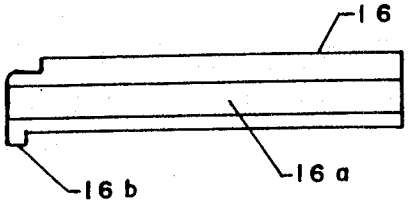
FIG. 4 shows a side elevational view of a flat compartment window member.

FIG. 4 shows a side view of the window member 16 representing a panel that also includes an extending lateral lip 16*b* at one end which represents a friction lock which fits flush against the forward edge opening to the compartment 14 when the window member 16 has been positioned as a cover over compartment 14. The length of the projection 16*b* is sized and shaped so that it conforms and fits flushly against a portion of the band wall to hold the picture, photographs or the like in position, preventing them from sliding out of the compartment. There is sufficient friction along the lateral slots 14*c* and the window member tabs 16*b* such that the window 16 will be held in place but can be removed by force quickly and easily by sliding the window member 16 towards the open direction of the compartment 14. Once removed other photos or pictures can be inserted.

Referring back to FIG. 1, it should be noted that as an additional embodiment a thin rectangular watch could be inserted in any one of the compartments in place of a window and attached to the compartment slots The band body is made transparent at least in the compartment areas so that the interior panels 12*a* and surfaces 14*a* and windows 16 are transparent. Two photographs, pictures or holograms or any two flat thin design exhibits back to back can be placed within each compartment so that, when the bracelet is removed from the user, a display of up to ten photos is provided.

The instant invention has been shown and described herein in what it is considered to be the most practical and preferred embodiment. It is recognized, however, that departures may be made therefrom within the scope of the invention and that obvious modifications will occur to a person skilled in the art.

What is claimed is:

1. An ornamental bracelet for use as an article of jewelry comprising:

an arcuately shaped molded band of a transparent plastic material sized and shaped to be received around the wrist of the wearer, said arcuate band body comprising a first molded inside surface wall arcuately shaped having a pair of free ends spaced apart, said arcuately shaped band body including a plurality of compartments comprised of three walls rising upwardly from the upper surface of said band, each compartment having a slidably removable transparent optically clear window panel and a flat surface, each of said compartments having sufficient space to fit a pair of thin indicia bearing sheets, whereby said indicia bearing sheets can be placed back to back to provide visible individual display exhibits of photographs, pictures or holograms that are visible outwardly and inwardly relative to said band.

2. An article of jewelry as in claim 1, wherein:

said ornamental band includes at least four separate compartments spaced apart along the exterior portion of the band.

3. An article of jewelry as in claim 1, wherein:

said band includes at least five separate compartments spaced equally apart, each of said compartments being substantially rectangular in configuration.

4. An ornamental article of jewelry as in claim 1, wherein:

each slidable window member includes a downwardly projecting lip portion at one end to frictionally lock the window to the band and to prevent the photographs from sliding out when the window member is closed and locked into the compartment.

5. An article of jewelry as in claim 4, wherein:

said central mounted compartment is sized for receiving a watch.

6. An article of jewelry as in claim 1, wherein:

the entire unit of compartments and band are molded as one piece of a transparent acrylic polymer.

7. An article of jewelry as in claim 1, wherein:

each compartment includes parallel walls with slots, and each window includes parallel tabs that fit slidably in said wall slots.

* * * * *